US011849765B2

(12) United States Patent
Michaud

(10) Patent No.: US 11,849,765 B2
(45) Date of Patent: Dec. 26, 2023

(54) LOCKING MECHANISM FOR A VAPORIZER CARTRIDGE IN A VAPE CONSUMPTION DEVICE

(71) Applicant: BEGREEN SUPPLY LLC, Las Vegas, NV (US)

(72) Inventor: Christopher Michaud, Cambridge, MA (US)

(73) Assignee: BeGreen Supply LLC, Somerville, MA (US)

( * ) Notice: Subject to any disclaimer, the term of this patent is extended or adjusted under 35 U.S.C. 154(b) by 477 days.

(21) Appl. No.: 17/111,710

(22) Filed: Dec. 4, 2020

(65) Prior Publication Data

US 2022/0175029 A1 Jun. 9, 2022

(51) Int. Cl.
*A24F 40/42* (2020.01)

(52) U.S. Cl.
CPC ..... *A24F 40/42* (2020.01)

(58) Field of Classification Search
None
See application file for complete search history.

(56) References Cited

U.S. PATENT DOCUMENTS

2022/0046988 A1* 2/2022 Blattler ..... A24F 40/42
2022/0175029 A1* 6/2022 Michaud ..... A24F 40/42
2022/0346445 A1* 11/2022 Yi ..... A24F 40/42

* cited by examiner

*Primary Examiner* — James Harvey
(74) *Attorney, Agent, or Firm* — Sunstein LLP

(57) ABSTRACT

The disclosure provides a locking mechanism for a vape cartridge. The locking mechanism can provide a sealed vape cartridge that cannot be opened by a force less than, for example, 20 kg. The use of tools is required to provide a force to open the sealed vape cartridge. The locking mechanism can provide evidence of tampering or of opening of the vape cartridge. The locking mechanism can provide quality assurance for vape materials during production, packaging, distribution, storage, and sale, while providing contamination free testing of vape materials at a quality control lab.

24 Claims, 10 Drawing Sheets

During Assembly
Pressure Release

LOCKING MECHANISM FOR A VAPORIZER CARTRIDGE IN A VAPE CONSUMPTION DEVICE

FIELD OF THE INVENTION

This disclosure relates to locking mechanisms for vape consumption devices and more particularly to locking mechanisms providing a tamper evident vaporizer cartridge and to methods of assembling and disassembling a vaporizer cartridge including the locking mechanisms.

BACKGROUND OF THE INVENTION

Vape consumption is a popular alternative to smoking tobacco. Smoking tobacco is known as the largest preventable cause of disease in the United States. Instead of inhaling cigarette smoke, the vape consumer inhales an aerosol, commonly called a vapor, provided by a combustion-free vape consumption device or e-cigarette. The vape consumption device can include a mouthpiece, a battery or other power source, to heat a heating element or atomizer, and a cartridge, reservoir, or pod, which holds a vape material (e.g., an e-liquid or e-juice) containing varying amounts of active ingredient (e.g., nicotine), flavorings, and other chemicals. Besides nicotine, vape consumption can be utilized for consumption of a variety of active ingredients such as nootropics and supplements.

A vape material can contain various ingredients. Commercial manufacturers of vape material seek to provide vape material that is pure and lab quality certified, free of toxins such as heavy metals, stable over time, and delivered to the end user in a sealed container or a sealed vape cartridge for quality assurance and child proof containment. Commercial manufacturers do not always have control of the vape material after it leaves the factory. Vape material containers and sealed vape cartridges are not always tamper proof. A vape cartridge can contaminate a vape material during closure, transport, storage, or opening of the cartridge.

What is needed are locking mechanisms for vape cartridges that provide quality assurance and tamper proof sealing for vape materials.

SUMMARY OF INVENTION

It is an object of the invention to provide locking mechanisms for a combustion-free vape consumption device or a vape cartridge, including materials and methods of making the locking mechanisms, and to provide methods of assembling and disassembling a vape cartridge including the locking mechanisms.

The technology can be further summarized in the following list of features:

1. A vape cartridge including: a subassembly base with a hollow cylinder having a first end, a second end, and an interior region for containing a vape material; and a hollow center post having a base portion affixed to the subassembly base proximate the first end of the hollow cylinder in the interior region and a top portion protruding out of the interior region of the hollow cylinder proximate the second end of the hollow cylinder; the top portion of the hollow center post having a post tip with a first diameter and a notch area below the post tip having a second diameter which is smaller than the first diameter; and a subassembly tip including: a mouthpiece; and a tip lock positioned within the mouthpiece and having a first end and a second end; the tip lock having a center bore extending from the first end to the second end and being configured to receive there-through the hollow center post of the base subassembly when the subassembly base and the subassembly tip are mated; the tip lock including a hook portion having a plurality of flexible hooks defining an opening of the center bore at the first end and being operative to flex outward away from the center bore when the post tip of the hollow center post passes through the opening of the center bore until the notch area on the hollow post is aligned with the flexible hooks which snap back to their unflexed positions and engage with the notch area of the hollow center post.

2. The vape cartridge of feature 1, wherein the opening of the center bore at the first end of the tip lock defines a third diameter which is less than the first diameter of the post tip and greater than the second diameter of the notch area.

3. The vape cartridge of feature 1, wherein each flexible hook includes an outer surface, together the outer surfaces defining an external surface of the hook portion.

4. The vape cartridge of feature 1, wherein the mouthpiece has a first end, a second end, and a center bore extending from the first end to the second end; wherein the center bore includes a first bore region located between the first end and the second end of the mouthpiece, the first bore region operative to receive the external surface of the hook portion of the tip lock when the tip lock is inserted into the center bore of the mouthpiece.

5. The vape cartridge of feature 4, wherein the tip lock includes a central portion located between the hook portion and the second end of the tip lock, the central portion having a flexible wing disposed about a periphery of and extending out from an outer surface of the central portion.

6. The vape cartridge of feature 5, wherein the flexible wing comprises a plurality of flexible wings disposed about a periphery of and extending out from an outer surface of the central portion.

7. The vape cartridge of feature 5, wherein the center bore of the mouthpiece includes a second bore region located between the first bore region and the second end of the mouthpiece, the second bore region including an inner surface with a circumferential groove disposed therein, the circumferential groove operative to receive and engage the flexible wing when the tip lock is inserted into the center bore of the mouthpiece.

8. The vape cartridge of feature 5, wherein the tip lock further includes a gasket engagement surface on an exterior of an end portion of the tip lock extending from the flexible wing to the second end of the tip lock.

9. The vape cartridge of feature 8, wherein the subassembly tip further includes a gasket member having a first end including a recess, the recess operative to receive the gasket engagement surface on an exterior of an end portion of the tip lock when the tip lock is mated to the gasket member; the gasket member further including a center bore extending from the first end to a second end, a gasket seal extending out from and about a periphery of the center bore at the first end, and one or more ridges along an outer surface of the gasket member extending from the gasket seal to proximate the second end of the gasket member; wherein when the tip lock is mated to the gasket member, the center bore of the gasket member is aligned with the center bore of the tip lock.

10. The vape cartridge of feature 9, wherein when the subassembly base and the subassembly tip are mated, the hollow center post of the subassembly base passes through the center bore of the gasket member, the center bore of the tip lock, and into the center bore of the mouthpiece until the post tip of the hollow center post is received within a third bore region of the center bore of the mouthpiece.

11. The vape cartridge of feature 9, wherein the one or more ridges are operative to retain the gasket in the interior region of the hollow cylinder after a disassembly of the subassembly base from the subassembly tip.

12. The vape cartridge of feature 1, wherein a force less than 6 kg will mate the subassembly base to the subassembly tip or will mate the tip lock to the mouthpiece; and wherein a force greater than 20 kg is required to disassemble the subassembly base from the subassembly tip or to un-mate the tip lock from the mouthpiece.

13. The vape cartridge of feature 12, wherein the force greater than 20 kg to disassemble the subassembly base from the subassembly tip will cause the flexible hooks to fail, and wherein the force greater than 20 kg to un-mate the tip lock from the mouthpiece will cause the flexible wing to fail.

14. The vape cartridge of feature 1, wherein disassembly of the vape cartridge results in a tamper-evident damage to the flexible hooks or results in a tamper-evident damage to the flexible wings.

15. The vape cartridge of feature 11, wherein the mouthpiece includes an edge formed at the second end of the mouthpiece between the inner surface of the second bore region and an exterior surface of the mouthpiece.

16. The vape cartridge of feature 15, wherein the edge at the second end of the mouthpiece extends outward from an outer surface of the hollow cylinder when the subassembly base is mated to the subassembly tip, and the edge is operative to receive a force greater than 20 kg.

17. The vape cartridge of feature 1, wherein the hollow center post includes a side hole traversing from the interior region of the hollow cylinder to an interior region of the hollow center post and positioned in the interior region of the hollow cylinder on the post diameter, wherein the side hole allows a pressure to release from the interior region of the cylinder and allows the pressure to traverse through the side hole during a mating of the subassembly tip and the subassembly base.

18. The vape cartridge of feature 17, wherein the center bore of a gasket member covers the side hole of the hollow center post after the subassembly tip is mated to the subassembly base.

19. The vape cartridge of feature 18, wherein the center bore of the gasket member covering the side hole prevents a leakage of vape material through the side hole.

20. The vape cartridge of feature 9, wherein the gasket member comprises silicone.

21. The vape cartridge of feature 1, wherein the hollow center post comprises stainless steel.

22. The vape cartridge of feature 1, wherein the hollow cylinder is transparent.

23. The vape cartridge of feature 1, wherein the mouthpiece comprises wood, metal, plastic, ceramic, polymer, or a combination thereof.

24. The vape cartridge of feature 1, wherein the tip lock comprises polymer, metal, alloy, composite, or a combination thereof.

The technology includes methods of assembling and disassembling a vape cartridge. For example, a locking mechanism for a vape cartridge is provided. The locking mechanism can provide a sealed vape cartridge that cannot be disassembled (e.g., that is un-openable) by human strength (e.g, a force less than about 20 kg) without the use of specific tools to provide a force that is greater than that of human strength (e.g., a force greater than about 20 kg). Disassembly of the vape cartridge results in an intentionally compromised status of the vape cartridge for the purpose of providing tamper evidency. Requiring a force that is greater than about 20 kg can also, for safety, provide a child proof vape cartridge. The locking mechanism herein can be referred to as an "SN3" locking mechanism.

BRIEF DESCRIPTION OF THE FIGURES

Embodiments of the present disclosure will now be described, by way of example only, with reference to the attached Figures, wherein.

DETAILED DESCRIPTION OF THE INVENTION

Figure 1:
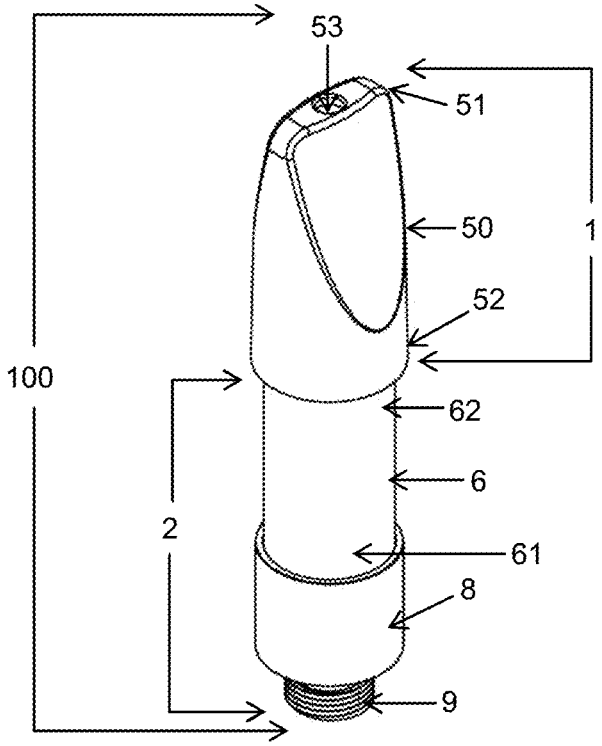
FIG. 1 shows a perspective view of an assembled vape cartridge in accordance with various embodiments.

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein.

Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The legal status of vape consumption devices or e-cigarettes is currently pending in some countries. In those countries that have legalized vape consumption devices, regulations requiring standardization and quality control for vape materials and vaporizers, disclosure of ingredients in vape materials, and child-proofing and tamper-proofing for packaging are either established or under consideration. To provide quality assurance, vape material can be provided in a sealed vape cartridge or sealed container that cannot be opened or disassembled by human strength, for example, a force greater than 20 kg, and that shows tamper evidence.

Evidence of tampering can be a visible failure or damage of one or more components of the vape cartridge. For example, if tools, impact, or prying forces are used to open or disassemble a vape cartridge, there can be visible evidence of the tampering. According to some aspects, evidence of tampering can be provided by the amount of force required to disassemble the vape cartridge. For example, if the vape cartridge is opened and then reassembled after opening, so as to appear untampered, there can be evidence that the vape cartridge has been opened. Less force may be required to disassemble the vape cartridge if the vape cartridge is reassembled after opening.

For the producers of vape material and vape cartridges, filling and assembly of the vape cartridge should be easily accomplished, for example, using assembly by hand or by a force less than about 6 kg. The vape cartridge should provide ample space for filling and should provide easy sealing. If the vape cartridge containing the vape material arrives at a quality assurance lab for testing, the lab technicians should be able to open the vape cartridge without contaminating the vape material therein and should be able to detect tampering. After opening the vape cartridge, the lab technicians should be able to easily sample the vape material without contaminating the vape material.

In one aspect, a vape cartridge including a locking mechanism is provided. The vape cartridge can be assembled by pressing a subassembly tip and a subassembly base together with a force less than 6 kg. After assembly, the vape cartridge requires a force greater than about 20 kg to disassemble the vape cartridge.

After disassembly in a controlled environment, the vape cartridge can provide the vape material without contamination, for example, for lab testing. During disassembly in a lab, if the vape cartridge can be disassembled by application of a force less than 20 kg, then the vape cartridge provides evidence of being disassembled or tampered with before disassembly in the lab. According to some aspects, visible tamper evidence can also be provided by failure, distortion, or bending of one or more components of the vape cartridge.

The preferred embodiment of a vape cartridge is depicted as an assembly for a vape consumption device, but it should be understood that this is only exemplary and that the concepts described herein are equally applicable to other applications, including but not limited to sealed containers, tamper resistant containers, counterfeit proof containers, and containers for providing quality assurance and testing for a material therein.

An assembled vape cartridge 100, according to an aspect of this disclosure, is depicted in FIG. 1. Referring to FIG. 1, the vape cartridge 100 has a subassembly tip 1 attached to a subassembly base 2. The subassembly base 2 includes a hollow cylinder 6 with a first end 61 and a second end 62. The hollow cylinder 6 has an interior region operative to contain a vape material. The length of the hollow cylinder 6 can be made longer to contain more vape material inside. The diameter of the hollow cylinder 6 can also be changed, for example, for different devices.

The subassembly tip 1 can be in the shape of a mouthpiece 50 having a first end 51, a second end 52, and a center bore 53 extending from the first end 51 to the second end 52. Disassembly of the vape cartridge 100 may require a force greater than 20 kg (which is greater than a human grip force) to pull the subassembly tip 1 from the subassembly base 2. The subassembly base 2 can have a screw 9 at bottom for attachment to a vape consumption device. The subassembly base 2 can have a shield 8 affixed to a first end of a hollow cylinder 61. In another example, the mouthpiece 50 with the center bore 53 can be replaced by a cap without a center bore, for example, to provide a sealed tamper proof container.

The mouthpiece or cap can, for example, include wood, metal, alloy, plastic, ceramic, polymer, or a combination thereof. The mouthpiece or cap can include a composite of materials, for example, a softer material or polymer can be utilized at an edge of the mouthpiece or cap. The softer material can be operative to indicate attempts at tampering with the edge of the mouthpiece or cap. In another example, the mouthpiece or cap can include a tamper indicating seal around an outer edge of the mouthpiece or cap. The seal can irreversibly break if the mouthpiece or cap is removed.

Figure 2:
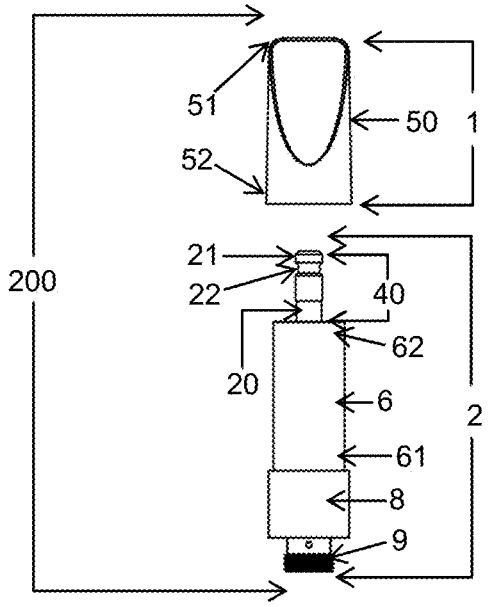
FIG. 2 shows a front view of a vape cartridge before assembly of the vape cartridge in accordance with various embodiments.

Assembly of the vape cartridge 100, may require a force less than 6 kg, so that human force alone may be used to assemble the components. A vape cartridge before assembly 200, according to an aspect of this disclosure, is depicted in FIG. 2. For example, the subassembly tip 1 and the subassembly base 2 can be pressed together by hand, by finger force, i.e. by a force less than 6 kg, to achieve the assembled vape cartridge 100, which is depicted in FIG. 1.

The subassembly base 2 depicted in FIG. 2 includes a hollow center post 20 with a top portion 40 protruding out of the interior region of the hollow cylinder 6 proximate the second end of the hollow cylinder 62. The top portion 40 has a post tip 21 with a first diameter and a notch area 22 below the post tip having a second diameter which is smaller than the first diameter. The locking mechanism, which prevents opening of the vape cartridge 100, includes the post tip 21 and the notch area 22 along with a tip lock, described below. The tip lock can be positioned inside a subassembly tip.

Subassembly Tip

Figure 3A:
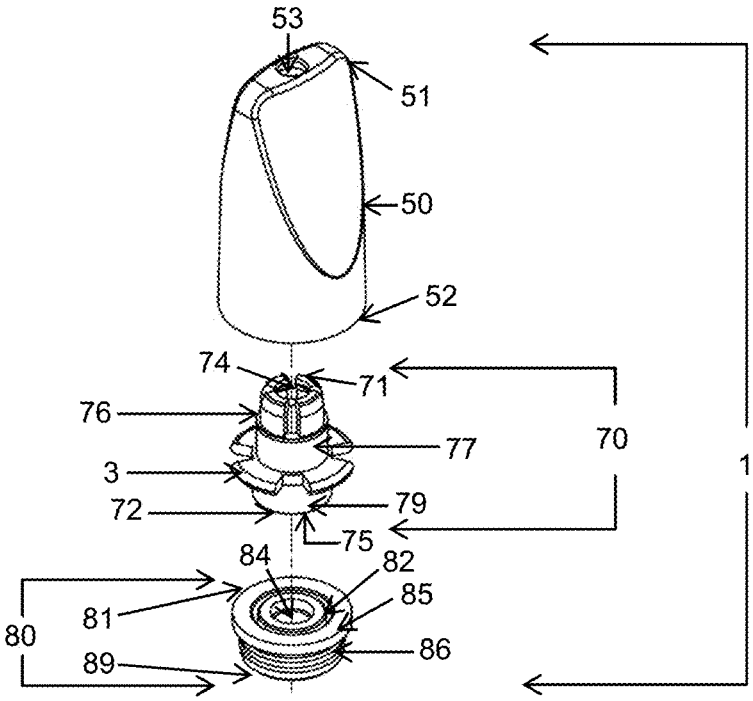
FIG. 3A shows a perspective view of an unassembled subassembly tip in accordance with various embodiments.

The subassembly tip 1 with the mouthpiece 50 depicted in FIG. 2 includes a tip lock positioned in the mouthpiece. An expanded view of the subassembly tip 1, showing the mouthpiece 50 and the tip lock 70, is depicted in FIG. 3A and in FIG. 3B. According to an aspect of this disclosure, FIG. 3A and FIG. 3B depict the subassembly tip 1 before the tip lock 70 and the mouthpiece 50 are mated with a force less than 20 kg.

Referring now to FIG. 3A, tip lock 70 is shown to include a first end 71 and a second end 72. The tip lock 70 includes a hook portion 76 having a plurality of flexible hooks which together define an opening 74 of a center bore at the first end 71. In this example there are four flexible hooks, however, fewer or more flexible hooks may be used. The center bore includes at the second end 72, another opening 75. At the second end 72, through the center bore opening 75, the top portion 40 of the hollow center post 20 of the subassembly base depicted in FIG. 2 is received there-through when the subassembly base and the subassembly tip are mated. In FIG. 3A, the plurality of flexible hooks 76 are operative to flex outward from the opening 74 of the center bore when the post tip 21 of the hollow center post 20, FIG. 2, passes through the opening 74, until the notch area 22 on the hollow center post is aligned with the flexible hooks 76, which snap back to their unflexed positions and engage with the notch area 22 of the hollow center post.

Figure 3B:
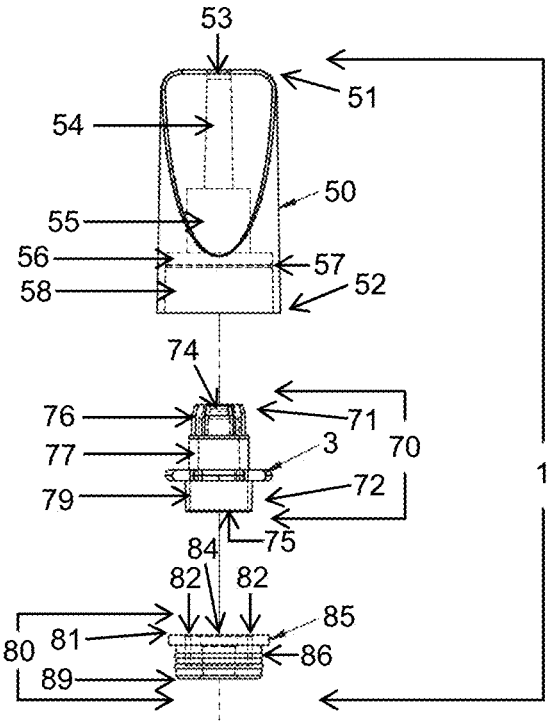
FIG. 3B shows a transparent schematic of an unassembled subassembly tip in accordance with various embodiments.

Continuing to refer to FIG. 3A and FIG. 3B, the tip lock 70 includes a central portion 77 located between the hook portion 76 and the second end of the tip lock 72. The central portion 77 has a flexible wing 3. The flexible wing 3 can include a plurality of flexible wings disposed about a periphery of and extending out from an outer surface of the central portion 77.

The mouthpiece 50 depicted in FIG. 3B has a first end 51, a second end 52, and a center bore 53 extending from the first end to the second end. The center bore 53 includes a first bore region 55 located between the first end and the second end of the mouthpiece. The first bore region 55 is operative to receive the external surface of the hook portion 76 of the tip lock 70 when the tip lock is inserted into the center bore of the mouthpiece. The center bore of the mouthpiece includes a second bore region 58 located between the first bore region 55 and the second end 52 of the mouthpiece. The second bore region 58 includes an inner surface with a circumferential groove 57 disposed therein. The circumferential groove 57 is operative to receive and engage the flexible wing 3 when the tip lock 70 is inserted into the center bore 53 of mouthpiece 50. For example, the flexible wing 3 can flex downward as it is inserted into second bore region 58 until it reaches circumferential groove 57 at which point the flexible wing 3 snaps into the circumferential groove 57, securing the tip lock 70 in place within the center bore 53 of mouthpiece 50. Engaging the flexible wing 3 within the circumferential groove 57 of the second bore region can require a force less than 6 kg.

The tip lock 70 can be manufactured from any suitable flexible material, for example, a material that can flex to a position and snap back. The material has a failure point and will not snap back after flexing to a failure position. In another example, a portion of the tip lock can include a thicker material (e.g., the central portion 77), while the one or more flexible hooks or the one or more flexible wings can be a thinner material, flexible and operative to snap back to their unflexed positions. Examples of materials are polycarbonate or other thermoplastics, a metal or alloy, synthetic polymers such as polyethylene, polypropylene, polystyrene, polyvinyl chloride, polyvinyl butyral, synthetic rubber, phenol formaldehyde resin, epoxy, neoprene, nylon, polyacrylonitrile, PTFE, and silicone. Natural fibers or materials can be utilized.

In an embodiment, the flexible wing 3 is less flexible compared to the flexible hooks 76. In this example, the less flexible wing 3 can be retained, engaged with the circumferential groove 57 in the mouthpiece 50, after a disassembly of the vape cartridge. In another embodiment, the flexible wing 3 can have similar flexibility as the hook portion 76. This configuration can cause the flexible wing 3 to disengage from the circumferential groove 57 in the mouthpiece 50 during a disassembly of the vape cartridge. It will be apparent based on this disclosure that the tip lock 70 can include different thicknesses of materials, flaps, or components so as to determine, for example, which components fail in the tip lock during a disassembly or tampering or to ensure assembly is performed in a specific order.

Referring now to FIG. 3A, the tip lock 70 includes a gasket engagement surface 79 on an exterior of an end portion of the tip lock at the second end 72. The gasket member 80 has a first end 81 including a recess 82. The recess 82 is operative to receive the gasket engagement surface 79 of the tip lock 70.

The gasket member 80 includes a center bore 84 extending from the first end 81 to the second end 89, which is aligned with the center bore of the tip lock 70. A gasket seal 85 extends out from and about a periphery of the center bore 84 at the first end 81. The gasket member 80 can include one or more ridges 86 along an outer surface of the gasket member extending from the gasket member proximate the second end 89 of the gasket member.

Figure 4A:
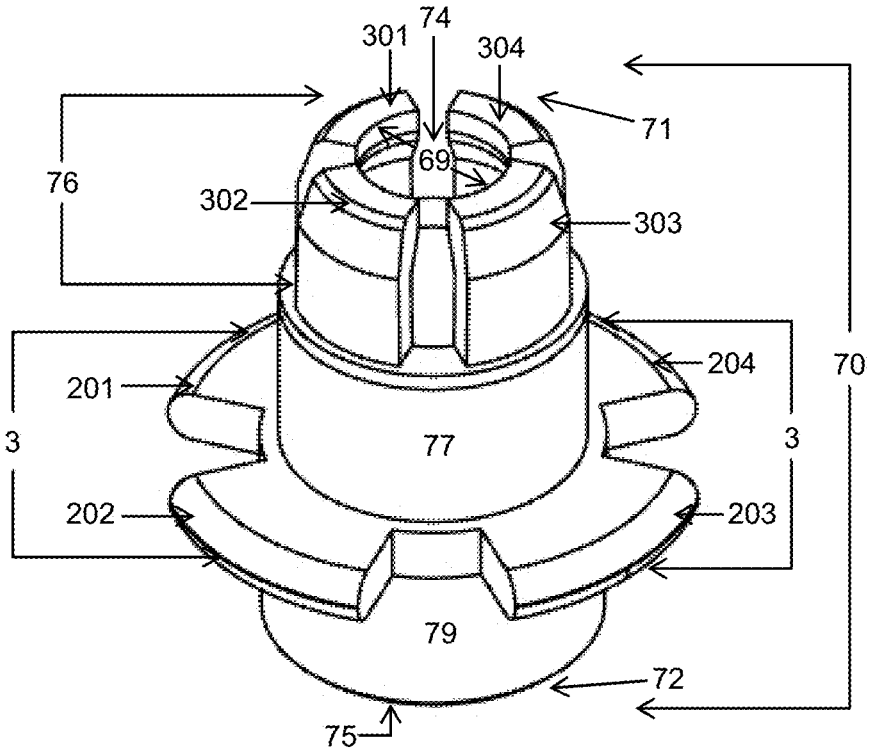
FIG. 4A shows a perspective view of a tip lock in accordance with various embodiments.

According to an aspect of this disclosure, FIG. 4A depicts a perspective view of the tip lock 70. In FIG. 4A, the hook portion 76 depicts flexible hooks 301, 302, 303, and 304, defining an opening 74 of center bore at the first end 71. The opening of the center bore 74 at the first end of the tip lock defines a third diameter 69 which is less than the first diameter of the post tip 21 and greater than the second diameter of the notch area 22 of the subassembly base 2 (FIG. 2).

Referring to FIG. 4A, the tip lock includes a central portion 77 located between the hook portion 76 and the second end of the tip lock 72. The central portion 77 has a flexible wing 3 disposed about a periphery of and extending out from an outer surface of the central portion. The flexible wing 3 can include a plurality of flexible wings, for example, flexible wings 201, 202, 203, and 204 are depicted in FIG. 4A. In some aspects, the number of flexible hooks (e.g., 301, 302, 303, 304) can be one or more provided the one or more flexible hooks are operative to flex outward away from the center bore opening 74 when the post tip of the hollow center post passes through the opening of the center bore until the notch area 22 on the hollow post is aligned with the one or more flexible hooks and operative to engage with the notch area 22 of the hollow center post.

Figure 4B:
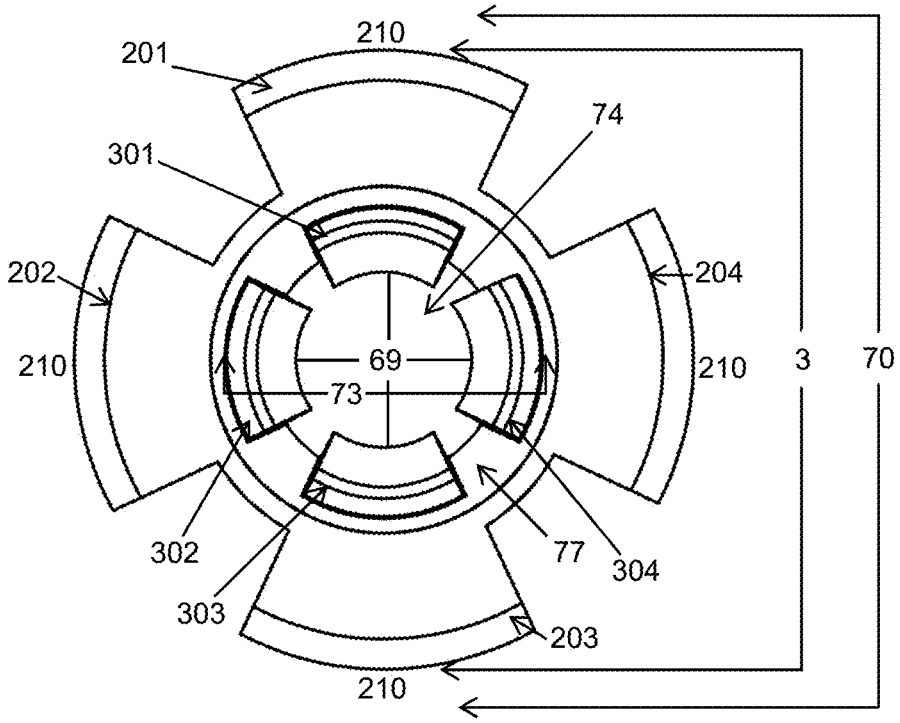
FIG. 4B shows a top view of a tip lock in accordance with various embodiments.

FIG. 4B depicts a top view of the tip lock 70. Referring now to FIG. 4B, the flexible wing 3 includes flexible wings 201, 202, 203, and 204. According to some aspects, the flexible wings include an outer diameter 210 operative to engage the circumferential groove 57 in the second bore 58 of the mouthpiece 50 depicted in FIG. 3B. The opening of the center bore 74 defines a third diameter 69. The flexible hooks 301, 302, 303, and 304 of the hook portion, depicted in FIG. 4B, each include an outer surface, together the outer surfaces defining an external diameter 73. The first bore region 55 of the mouthpiece 50, depicted in FIG. 3B, is operative to receive the external diameter 73 of the hook portion when the tip lock is inserted into the center bore of the mouthpiece. A side view of the tip lock 70, referring now to FIG. 4C, also depicts the external diameter 73 of the hook portion 76.

Figure 4C:
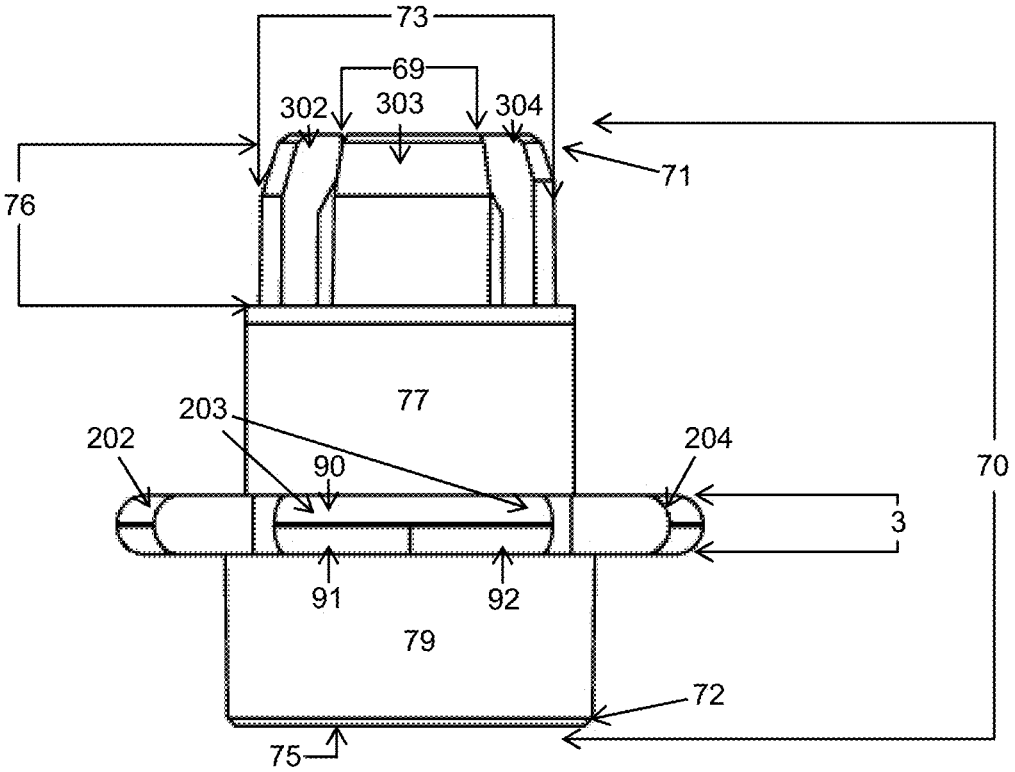
FIG. 4C shows a side view of a tip lock in accordance with various embodiments.

The flexible wing 3 depicted in FIG. 4C shows flexible wing 202, 203, and 204. According to some aspects, the flexible wing 203 depicts a top wing flap 90, a first bottom wing flap 91, and a second bottom wing flap 92. Each flexible wing can include components or flaps. Each component or flap can include a different size. The different sizes, for example, can provide a tamper evidency of the flexible wing. When the tip lock 70 is pressed into the mouthpiece (FIG. 3B), in some aspects, the wing flaps 90, 91, and 92 and the flexible wing 3 can engage the circumferential groove 57 by flexing past the circumferential groove into an upper second bore region 56 (FIG. 3B) above the circumferential groove. The flexible wing 3 can include a bevel. For example, the wing flap 90 has a top bevel and a bottom division adjoining wing flap 91. The top bevel can facilitate engagement of the flexible wing 3 with the circumferential groove 57 yet prevent disengagement of the flexible wing from the circumferential groove 57 without irreversibly bending the wing flap 90.

Figure 5:
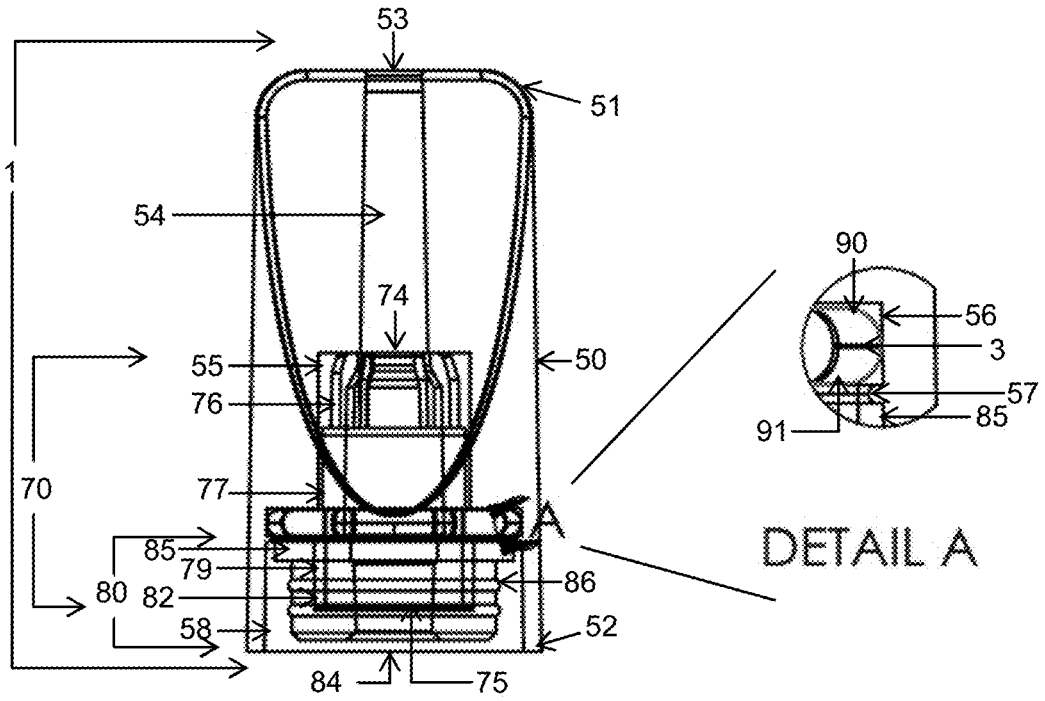
FIG. 5 shows a transparent side schematic of an assembled subassembly tip including a mouthpiece, a tip lock, and a gasket member in accordance with various embodiments.

According to an aspect of this disclosure, FIG. 5 depicts a transparent side view of the subassembly tip 1 with the tip lock 70 positioned in the mouthpiece 50 and the gasket member 80 positioned in the mouthpiece 50.

In FIG. 5, the hook portion 76 of the tip lock is positioned in the first bore region 55 of the mouthpiece 50. The flexible wing 3 can be engaged with the circumferential groove 57 by pressing the tip lock 70 and the mouthpiece 50 together. A force greater than 20 kg is required to disengage the flexible wing 3 from the circumferential groove 57. According to some aspects, the flexible wing will provide evidence of disengagement from the circumferential groove 57 by a bending of the flexible wing after the tip lock is removed from the mouthpiece. The evidence of disengagement can be a bending of components of the flexible wing 3, for example, the wing flaps 90, 91, 92. In some embodiments, the flexible wing 3 does not include the components or flaps (e.g., 90, 91, 92) and is a single flexible wing. In another embodiment, the flexible wing includes one or more flexible wings operative to engage with the circumferential groove 57.

Referring now to FIG. 5, the DETAIL A depicts an enlarged view of the flexible wing 3 engaged with the circumferential groove 57. The flexible wing is engaged in a second bore region 56 above the circumferential groove 57. For example, a pulling of the flexible wing 3 downward past the circumferential groove 57 causes a failure of the flexible wing 3, a failure of the wing flap 90, or both.

In the subassembly tip 1 depicted in FIG. 5, the gasket seal 85 of the gasket member 80 is within the second bore region 58 of the mouthpiece 50. The one or more ridges 86 along an outer surface of the gasket member 80 are extending in the second bore region 58. The center bore of the gasket member 84 is aligned with the center bore opening 75 of the tip lock at the second end of the tip lock and with the opening 74 of center bore at the first end. The subassembly tip 1 is operative to receive the top portion 40, depicted in FIG. 6, of the hollow center post 20 of the subassembly base 2. In an assembly of the vape cartridge, the post tip with a first diameter 25 (FIG. 6) can be inserted into the center bore of the gasket member 84 (FIG. 5). The subassembly base 2 can then be pressed together with the subassembly tip 1.

Subassembly Base

Figure 6:
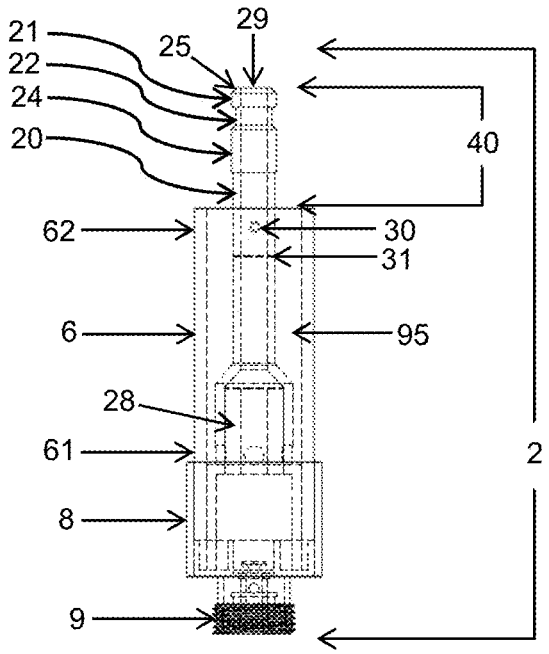
FIG. 6 shows a transparent schematic of a subassembly base before assembly of a vape cartridge in accordance with various embodiments.

According to an aspect of this disclosure, FIG. 6 depicts a transparent schematic of the subassembly base 2. The subassembly base 2 includes a hollow cylinder 6 having a first end 61, a second end 62, and an interior region 95 for containing a vape material. A hollow center post 20 has a base portion 28 affixed to the subassembly base proximate the first end 61 of the hollow cylinder in the interior region. The hollow center post 20 has a top portion 40 protruding out of the interior region of the hollow cylinder proximate the second end 62 of the hollow cylinder. The top portion 40 of the hollow center post has a post tip 21 with a first diameter and a notch area 22 below the post tip having a second diameter which is smaller than the first diameter.

The hollow cylinder can be transparent. The hollow cylinder can include, for example glass, polyethylene terephthalate, polyvinyl chloride, polypropylene, polystyrene, polycarbonate, polymethyl methacrylate, or a combination thereof. In another example, a vape material may be sensitive to light, and the hollow cylinder includes an opaque material. The hollow cylinder can include a coating, for example, to filter out UV light but to allow passage of visible light.

In FIG. 6, an optional chamfer 25 is illustrated above the post tip 21. For example, at initiation of assembly of the subassembly tip and the subassembly base, the chamfer can guide the top portion 40 of the hollow center post into the center bore 84 of the gasket member depicted in FIG. 5. In FIG. 6, an optional third diameter 24 is illustrated below the notch area 22.

The hollow center post 20 has a post diameter at a through hole 30. The through hole 30 traverses from the interior region 95 of the hollow cylinder 6 to an interior region 29 of the hollow center post. The post diameter at the through hole 30 is configured so the diameter of the center bore of the gasket member 84 (FIG. 3A, FIG. 5) will cover the through hole 30 after the subassembly tip 1 is pressed together with the subassembly base 2. For example, the through hole 30 allows pressure to escape or release from the interior region 95 to the interior region 29 of the hollow center post 20 when the subassembly tip 1 is pressed together with the subassembly base 2 during assembly of the vape cartridge. In some aspects, the pressure release prevents over pressurization of the vape cartridge during assembly. Over pressurization of a vape cartridge during assembly can result in leakage of a vape cartridge after assembly of the vape cartridge. For example over pressurization can saturate a wick contained in a vape cartridge, and the saturation can result in leakage.

According to some aspects, the gasket member 80 can be placed on the subassembly base 2 without the recess 82 of the gasket member being engaged with the gasket engagement surface of the tip lock 79. If the center bore of the gasket member 84 is placed on the center post 20 and the gasket member pressed downward such that the second end of the gasket member 89 enters the interior region 95, the through hole 30 can allow pressure to escape from the interior region 95 as the gasket member is pressed downward.

The interior region 95 of the hollow cylinder can be easily filled with a vape material before assembly of the vape cartridge. A fill line 31, depicted in FIG. 6 and in FIG. 10, can provide a maximum fill gauge for a vape material when a vape material is placed in the interior region 95 of the hollow cylinder 6.

The second end of the hollow cylinder 62 shown in FIG. 6 can insert into the second bore region 58 of the mouthpiece. Depicted in FIG. 5, the second bore region 58 of the mouthpiece is configured to receive the second end of the hollow cylinder 62, which is shown in FIG. 6. After the second end of the hollow cylinder 62 is positioned in the second bore region 58, the one or more ridges 86 along an outer surface of the gasket member 80 engage with the interior of the hollow cylinder 6. The gasket seal 85 of the gasket member 80 will seal the second end 62 of the hollow cylinder 6. The second end of the gasket member 89 will enter the interior of the hollow cylinder above the fill line 31.

The hollow cylinder 20 can be fabricated from stainless steel, for example, to prevent contamination of a vape material by heavy metals. The fill line 31 can be machined into the material of the hollow cylinder. The hollow cylinder can include, for example, a silicone coating or a chemical vapor deposition coating to prevent contamination of the vape material. If the hollow cylinder is fabricated from nickel, aluminum, zinc, copper, or iron, a coating may be applied.

Assembly of the Vape Cartridge

The subassembly tip 1 depicted in FIG. 5 can be assembled by providing a mouthpiece 50 having a first end 51 and a second end 52 and a center bore 53 extending from the first end to the second end; wherein the center bore of the mouthpiece includes a second bore region 58, the second bore region including an inner surface with a circumferential groove 57 disposed therein, the circumferential groove operative to receive and engage the flexible wing 3 of a tip lock 70 when the tip lock is inserted into the center bore of the mouthpiece. Inserting the tip lock 70 into the mouthpiece 50 until the circumferential groove 57 receives and engages the flexible wing 3 of the tip lock can provide the subassembly tip 1 using a pressing force. The gasket member 80 can be pressed into the subassembly tip 1 with the recess 82 at the first end of the gasket member receiving the gasket engagement surface 79 of the tip lock 70.

The subassembly tip 1 and the subassembly base 2 can be pressed together with a force less than 6 kg. The tip lock 70 and the gasket member 80, depicted in FIG. 5, can be positioned in the mouthpiece 50 before pressing the subassembly tip and the subassembly base together. For example, referring to FIG. 5 and to FIG. 6, during assembly of a vape cartridge, the hollow center post 20 of the subassembly base 2 passes through the center bore of the gasket member 84, the center bore of the tip lock 75 at the second end of the tip lock, the opening 74 of center bore of the tip lock defined by the flexible hooks 76, and into the center bore of the mouthpiece until the post tip of the hollow center post is received within a third bore region 54 of the center bore of the mouthpiece.

In another example, the third bore region 54 of the mouthpiece is optional. Assembly of the vape cartridge can be accomplished by providing the subassembly base 2 (FIG. 6) and the subassembly tip 1 (FIG. 5), placing the hollow center post 20 of the subassembly base into the center bore 84 of the gasket member tip lock at the second end 52 of the mouthpiece (FIG. 5), and passing the post tip 21 of the hollow center post through the opening of the center bore until the notch area 22 on the hollow post is aligned with the flexible hooks 76, which snap back to their unflexed positions and engage with the notch area of the hollow center post.

Figure 7:
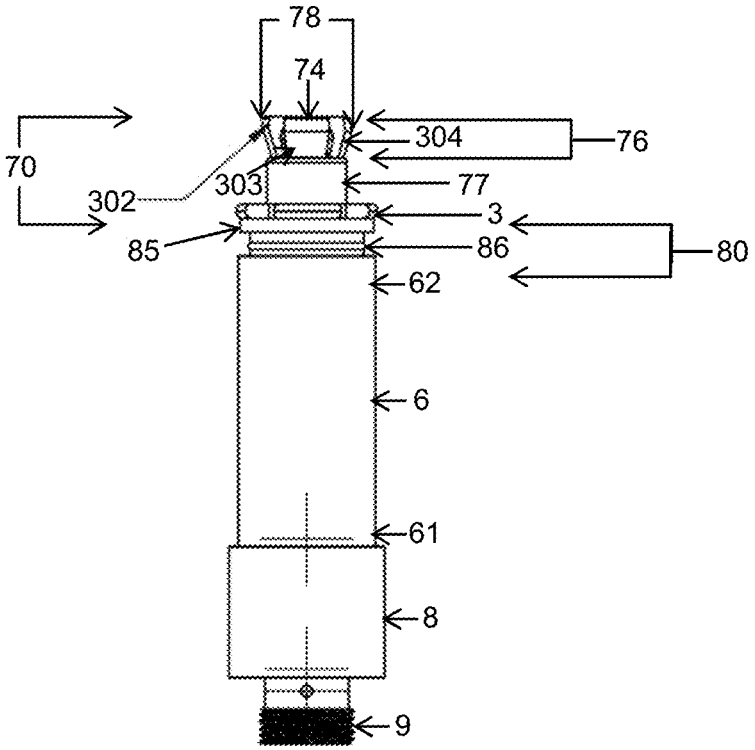
FIG. 7 shows a side view during an assembly of a vape cartridge, illustrated without a mouthpiece, in accordance with various embodiments.

An assembly of a vape cartridge is depicted without the mouthpiece, for example, to visualize flexing of the flexible hooks. According to an aspect of this disclosure, FIG. 7 depicts the hook portion 76 of the tip lock flexing outward away from the opening 74 of the center bore when the post tip 40 of the hollow center post passes through the opening of the center bore. In FIG. 7, the flexible hooks 302, 303, and 304 are depicted flexing outwards to a flexed outer diameter 78 as the post tip with a first diameter 21 passes through the opening 74 of the center bore. In some embodiments, the first bore region 55 of the mouthpiece 50 (FIG. 5) can have a diameter less than the flexed diameter 78.

Figure 8:
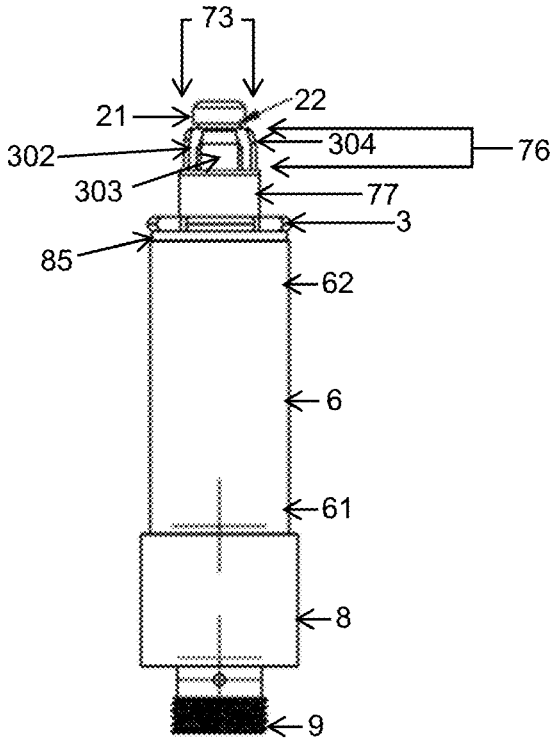
FIG. 8 shows a side view of assembly of a vape cartridge, illustrated without a mouthpiece, in accordance with various embodiments.

FIG. 8 depicts the flexible hooks 302, 303, and 304 snapped back to their unflexed positions after the notch area 22 of the center post is aligned with the flexible hooks. The hook area 76 including the flexible hooks is engaged with the notch area 22. A force greater than 20 kg is required to pull the tip lock up after the engagement of the flexible hooks 76 with the notch area 22. Although the mouthpiece 50 is not shown in FIG. 7 and in FIG. 8, the flexible wing 3 of the tip lock can be engaged with the circumferential groove 57 of the mouthpiece, with the tip lock positioned inside the mouthpiece during the assembly depicted in FIG. 7 and FIG. 8.

During an assembly of the vape cartridge depicted in FIG. 7, the gasket member 80 is entering the interior of the second end 62 of the hollow cylinder 6. During an assembly of the vape cartridge, the gasket member 80 can prevent contamination of vape material, for example, contamination by particles falling into the vape material during assembly. The one or more ridges 86 along an outer surface of the gasket member 80 can engage with the interior of the hollow cylinder 6 during assembly.

Figure 9:
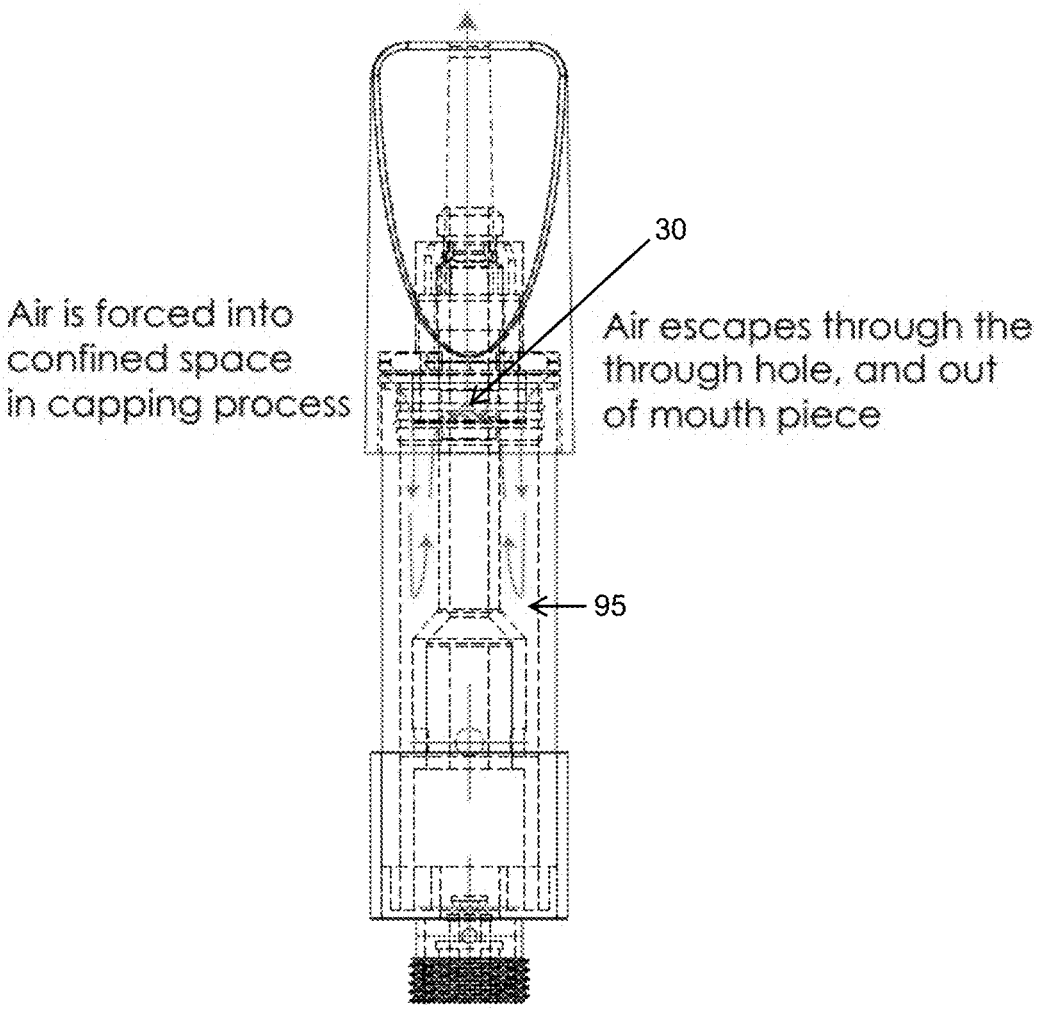
FIG. 9 shows a schematic of pressure release during assembly of a vape cartridge in accordance with various embodiments.

Referring now to FIG. 8, the hook area 76 is engaged with the notch area 22. The gasket seal 85 seals the second end 62 of the hollow cylinder 6. Pressure inside the interior region of the hollow cylinder 6 can be released during assembly via the through hole 30 depicted in FIG. 6 and in FIG. 9. An illustration of the pressure release is depicted in FIG. 9, wherein arrows illustrate pressure traversing from the interior region 95 into the through hole 30 and out of the mouthpiece. After the vape cartridge is assembled, the gasket member 80 covers the through hole 30 to prevent a leakage of the vape material from the through hole. The fill line 31, depicted in FIG. 6, FIG. 10, and in FIG. 11, can be positioned below the second end of the gasket member so that there is a small air space between the vape material and the gasket member during an assembly of the vape cartridge.

According to some aspects, the mouthpiece can be pressed on after an engagement of the flexible hooks 76 with the notch area 22 (e.g., FIG. 8). For example, assembly of the vape cartridge can be accomplished by placing the gasket member 80 and the tip lock 70 on the center post 20 of the subassembly base. In this example, the post tip 21 of the hollow center post passes through the opening 74 of the center bore until the notch area 22 on the hollow post is aligned with the flexible hooks 76, which snap back to their unflexed positions and engage with the notch area of the hollow center post. Afterwards, the mouthpiece 50 can be pressed together with the assembly depicted in FIG. 8 until the flexible wing 3 engages with the circumferential groove 57 and/or the second bore above the circumferential groove 56 in the mouthpiece, requiring a force less than 20 kg. As described below, in some embodiments, the mouthpiece cannot be pressed on after an engagement of the flexible hooks 76 with the notch area 22.

In some embodiments, assembly of the vape cartridge can require pressing the subassembly tip 1, (with the tip lock 70 and the gasket member 80 pre-positioned in the subassembly tip), together with the subassembly base 2. In some embodiments, a mouthpiece 50 cannot be pressed onto the assembly depicted in FIG. 8 because the flexible wing 3 will not engage with the circumferential groove 57 and/or the second bore above the circumferential groove 56 in the mouthpiece with a force less than 20 kg. For example, the flexible wing 3 depicted in FIG. 8 can contact the gasket seal 85, and the contact can be operative to prevent the flexible wing 3 from flexing and engaging with the circumferential groove 57 and/or the second bore above the circumferential groove 56 in the mouthpiece with a force less than 6 kg. In this example, assembly of the vape cartridge requires positioning the tip lock 70 into the mouthpiece 50 before assembly of the vape cartridge. Such a required assembly order can be by design, for example, by selecting the thickness of the wing 3 of tip lock 70. A required assembly step can be designed, for example, to ensure consistency during production and assembly, to prevent contamination of a vape material during assembly of a vape cartridge, or to prevent a tampering during assembly.

Disassembly of the Vape Cartridge

Figure 10:
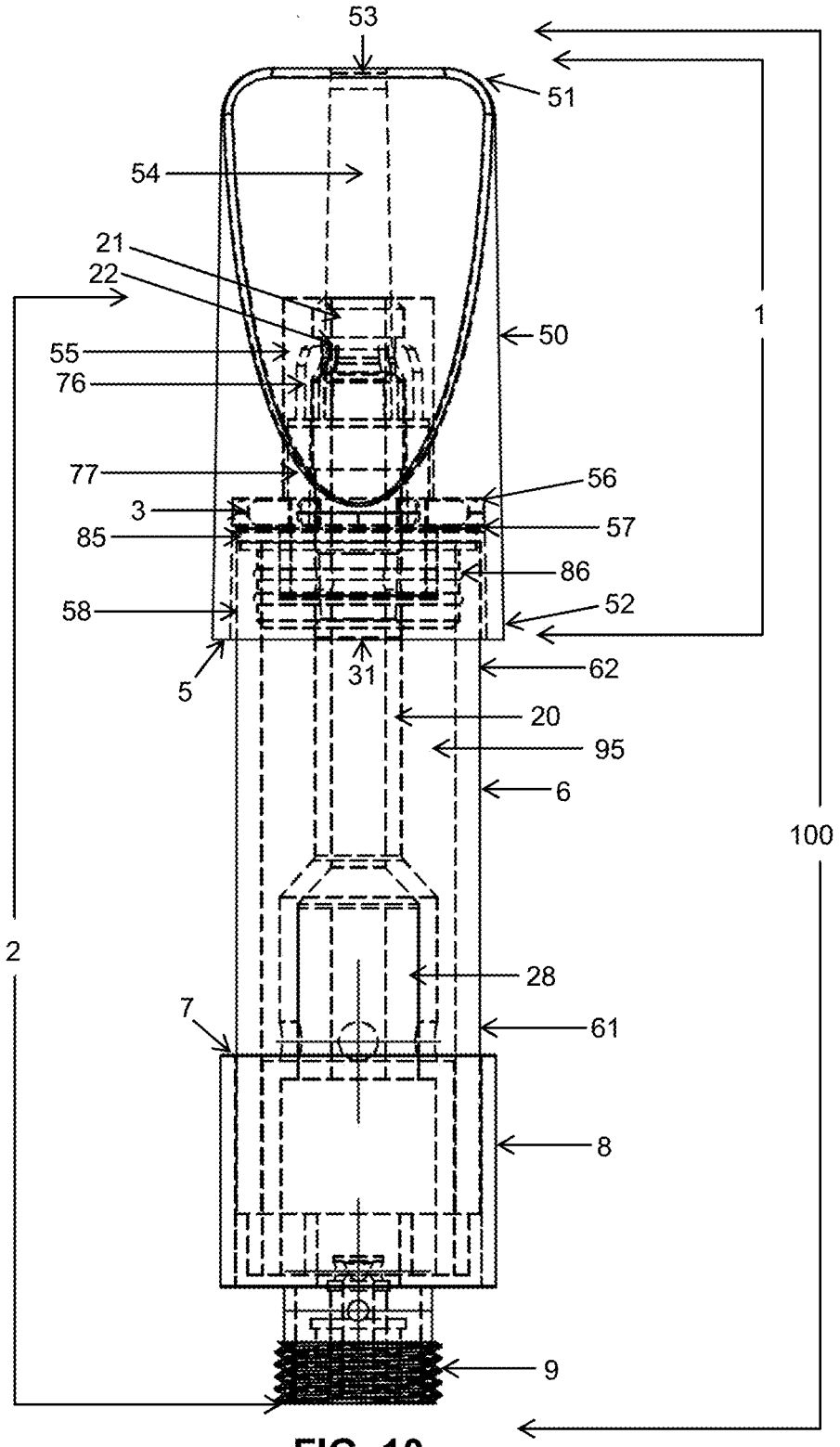
FIG. 10 shows a transparent schematic of an assembled vape cartridge in accordance with various embodiments.
Figure 12A:
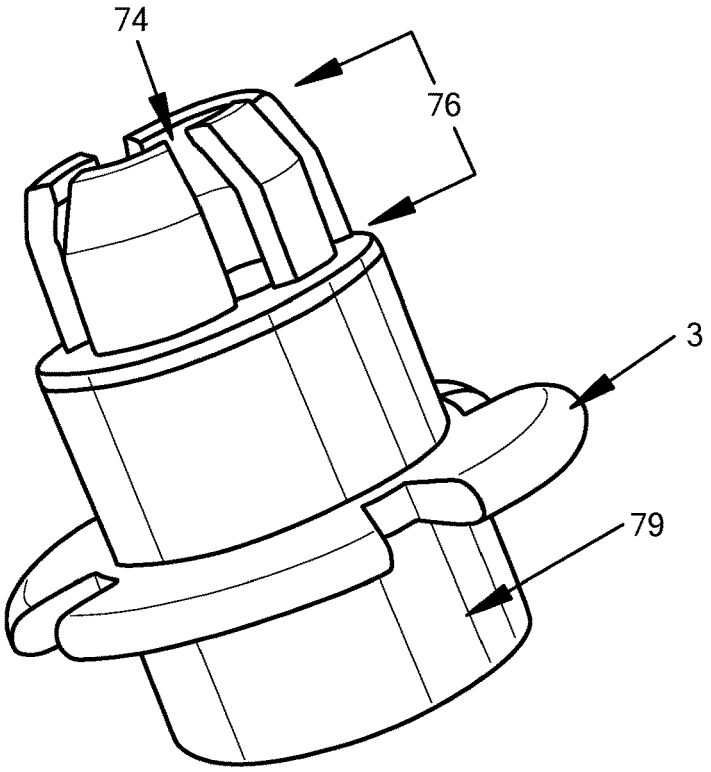
FIG. 12A shows a photo of a tip lock before assembly in a vape cartridge in accordance with various embodiments.

FIG. 12A shows a photo of a tip lock before assembly in a vape cartridge. FIG. 10 depicts a transparent schematic of an assembled vape cartridge 100. Referring to FIG. 10, when the notch area 22 on the hollow post is aligned with the flexible hooks 76, the flexible hooks have snapped back to their unflexed positions and engaged with the notch area 22 of the hollow center post, preventing disassembly of the vape cartridge 100. Disassembly of the vape cartridge 100 requires pulling the post tip 21 from the hook portion 76 of the tip lock, which is engaged with the notch area 22 of the center post 20. The pulling requires a force greater than about 20 kg, greater than human grip force. As the post tip 21 is pulled from the hook portion 76 of the tip lock, a failure of the flexible hooks of the tip lock occurs. Failure of the flexible hooks can cause a visible damage to the flexible hooks, for example, as shown in the photo presented in FIG. 12B.

Failure of the flexible hooks can cause the hook portion 76 of the tip lock to no longer engage with the notch area 22. For example, if the assembled vape cartridge 100 is disassembled and then reassembled (e.g., reassembled to appear untampered), the hook portion 76 will not engage with the notch area 22 such that a force greater than 20 kg is required to disassemble the vape cartridge a second time. A failure of the hook portion 76 can provide tamper evidence of the vape cartridge, for example, by requiring less force to disassemble the vape cartridge 100.

Referring again to FIG. 10, the flexible wing 3 of the tip lock is engaged with the circumferential groove 57 in the second bore region 58 of the mouthpiece 50 at the second bore region 56 above the circumferential groove. A disassembly of the vape cartridge 100 can disengage the flexible wing 3 from the circumferential groove 57. A force greater than 20 kg is required to disengage the flexible wing 3 from the circumferential groove 57. According to some aspects, disengaging the flexible wing 3 from the circumferential groove and will cause a failure of the flexible wing 3. As depicted in FIG. 4C, the flexible wing can include flaps or components (90, 91, 92) that can irreversibly bend after disengaging the flexible wing 3 from the circumferential groove 57. In the example depicted in FIG. 4C, the top flap 90 of the flexible wing 203 includes a top bevel that facilitates entry of the top flap 90 into the second bore region 56 above the circumferential groove 57, but the top flap 90 can irreversibly bend upwards when the flexible wing 203 is disengaged from the circumferential groove.

In the example depicted in FIG. 10, the mouthpiece 50 of the subassembly tip 1 includes an edge 5 formed at the second end 52 of the mouthpiece between the inner surface of the second bore region 58 and an exterior surface of the mouthpiece. The force that can be applied to the edge 5 by a consumer is limited because the small size of the edge does not allow a consumer to grip the edge and to pull the subassembly tip from the subassembly base. The size of the edge 5 can be set based on human strength of the strongest consumers. For example, the size of the edge between the inner surface of the second bore region 58 and an exterior surface of the mouthpiece can be in the range from 0.01 mm to 3 mm, or from 0.01 mm to 2 mm, from 0.01 mm to 1 mm, or from 0.01 mm to 0.5 mm. If the size of the edge 5 is sufficiently small, it will ensure that no consumers will be able to open the vape cartridge by application of a human force. The small size of the edge 5 can prohibit a human force providing a force greater than about 20 kg to disassemble the vape cartridge. As used herein, a force greater than about 20 kg is a force greater than can be applied by a human hand grip to the (small) edge 5. In some embodiments, a force greater than about 20 kg is a force that can be applied by a tool to the edge 5. In some embodiments, a specific tool can be used to grip the edge 5 to provide a force greater than about 20 kg. According to some aspects, the edge 5 is optional, and a gripping tool is utilized to pull the subassembly tip from the subassembly base, without using an edge 5 to provide a force greater than about 20 kg. A force to assemble a vape cartridge can be, for example, less than about 20 kg, less than about 10 kg, less than about 6 kg, less than about 5 kg, less than about 4 kg, less than about 3 kg, less than about 2 kg, or less than about 1 kg. A force to disassemble a vape cartridge, in some embodiments assuming a human grip on an edge 5 (FIG. 10), which can also be applied by a specific tool, can be for example, greater than about 6 kg, greater than about 10 kg, greater than about 15 kg, or greater than about 20 kg. It will be apparent based on this disclosure that the edge 5 is configured so it does not provide sufficient human grip to open a vape cartridge. Force applied to the edge 5 can be accomplished, according to some aspects, with a disassembly tool. In some embodiments, human pulling grip will not grip the edge 5 to apply a force to disassemble a vape cartridge. For example, a tamper proof, child-proof, quality assured, and secure vape cartridge can be provided. Assembly of a vape cartridge can be accomplished with a pushing force. As used herein, the term "about" refers to a range of within plus or minus 10% of the stated value.

The edge 5 of the subassembly tip 1 can provide a surface for application of a tool to apply a force greater than 20 kg to pull the subassembly tip 1 and the subassembly base 2 apart. The subassembly base may also be gripped during disassembly. For example, the edge 7 of the subassembly base 2 can provide a surface to grip the subassembly base during a disassembly. Any part of the subassembly base 2, for example, the screw 9, the shield 8, or the hollow cylinder 6, can be utilized to grip the subassembly base 2 when a force greater than 20 kg is applied to pull the subassembly tip 1 from the subassembly base 2. A specific tool can be required to pull the subassembly tip 1 and the subassembly base 2 apart. The tool can include a gauge to measure the force required to pull the subassembly tip 1 and the subassembly base 2 apart.

The first bore region 55 of the mouthpiece 50 can be configured to hold the exterior surfaces of the plurality of flexible hooks in the hook portion 76 in the outer diameter 73 depicted in FIG. 8. The first bore region 55 can prevent the plurality of flexible hooks in the hook portion 76 from flexing to a flexed diameter 78, which is depicted in FIG. 7. The first bore region 55 can be configured to provide a one-time assembly, allowing the flexed diameter 78 for a one time assembly, but restricting the flexed diameter and causing a failure of the flexible hooks upon a disassembly of the vape cartridge 100. For example, pulling the post tip 21 from the hook portion 76 of the tip lock, which is engaged with the notch area 22 of the center post 20 can be restricted by the diameter of the first bore region 55.

Figure 11:
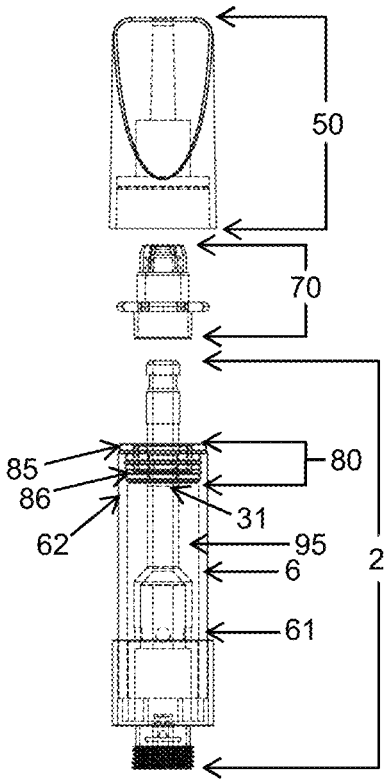
FIG. 11 shows a side view of a vape cartridge after disassembly in accordance with various embodiments.

A schematic of a vape cartridge after disassembly, according to an aspect of this disclosure, is depicted in FIG. 11. After a disassembly of the vape cartridge, the gasket member 80 is retained in the interior region 95 of the hollow cylinder 6 at the second end of the hollow cylinder 62. The gasket seal 85 seals the hollow cylinder 6, preventing contamination of the vape material during and after disassembly. The one or more ridges 86 along an outer surface of the gasket member can keep the gasket member 80 lodged in the interior region 95, with the gasket seal covering the second end of the hollow cylinder 62. According to some aspects, the fill line 31, which illustrates a maximum fill gauge for vape material, can ensure the vape material does not contact the gasket member 80.

The gasket member can include, for example, silicone or a material suitable for flexibility while ensuring the vape material is not contaminated. The gasket member can include, for example, a chemical resistant material, a material providing stability over time, a material that will not shrink or swell, or a combination thereof.

If the vape cartridge is disassembled in a quality testing lab, a lab technician can remove or bend upwards the gasket member 80 depicted in FIG. 11 using, for example, tweezers. A sampling needle can be inserted into the interior region 95 to sample the vape material for testing, without contamination of the vape material. Measurement of the force required to disassemble the vape cartridge can be accomplished during disassembly in the lab, for example, using a disassembly tool. Examples of devices that can be used to measure applied force are spring scales, strain gauges, load cells, stretch sensors, and weight scales. If a force less than 20 kg can be used to disassemble the vape cartridge, the force less than 20 kg can provide tamper evidency. Tamper evidency may also be provided, for example, by visible distortion to the tip lock, distortion of an edge of the mouthpiece, distortion of the flexible wing, or distortion of components or flaps of the flexible wing.

Figure 12B:
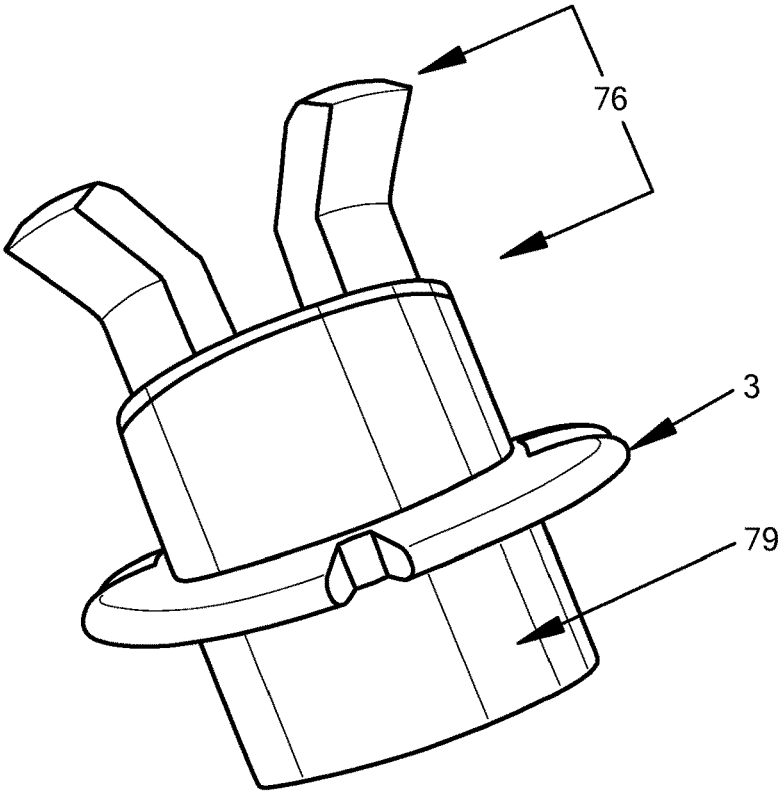
FIG. 12B shows a photo of a tip lock after disassembly from a vape cartridge in accordance with various embodiments.

According to an aspect of this disclosure, FIG. 12A shows a photo of a tip lock before assembly in a vape cartridge. The hook portion 76 defines a center opening 74 of the center bore. The flexible hooks are operative to flex away from the center bore and to snap back to their original positions. According to some aspects, FIG. 12B shows a photo of a tip lock after disassembly of a vape cartridge. The hook portion 76 is failed and bent outwards away from the opening of the center bore. The flexible hooks are not operative to snap back to their original positions shown in FIG. 12A. In some aspects, tamper evidence can be achieved by a failure of the flexible hooks. The failure of the flexible hooks can result in disassembly of the vape cartridge requiring less than force 20 kg. After disassembly of the vape cartridge, the tip lock can be visually inspected by hand, for example. In FIG. 12B, the gasket engagement surface 79, the flexible wing 3, and the flexible hook are not contaminated with vape material.

While the foregoing description enables one of ordinary skill to make and use what is considered presently to be the best mode of the all-angle ground clamp, those of ordinary skill will understand and appreciate the existence of variations, combinations, and equivalents of the specific embodiments and examples herein. The above-described embodiments of the present invention are intended to be examples only. Alterations, modifications and variations may be effected to the particular embodiments by those of skill in the art without departing from the scope of the invention, which is defined solely by the claims appended hereto.

The invention is therefore not limited by the above described embodiments and examples, embodiments, and applications within the scope and spirit of the invention claimed as follows.

The invention claimed is:

1. A vape cartridge comprising:

a subassembly base comprising:

a hollow cylinder having a first end, a second end, and an interior region for containing a vape material; and a hollow center post having a base portion affixed to the subassembly base proximate the first end of the hollow cylinder in the interior region and a top portion protruding out of the interior region of the hollow cylinder proximate the second end of the hollow cylinder;

the top portion of the hollow center post having a post tip with a first diameter and a notch area below the post tip having a second diameter which is smaller than the first diameter; and a subassembly tip comprising:

a mouthpiece; and a tip lock positioned within the mouthpiece and having a first end and a second end;

the tip lock having a center bore extending from the first end to the second end and being configured to receive there-through the hollow center post of the base subassembly when the subassembly base and the subassembly tip are mated; the tip lock including a hook portion having a plurality of flexible hooks defining an opening of the center bore at the first end and being operative to flex outward away from the center bore when the post tip of the hollow center post passes through the opening of the center bore until the notch area on the hollow post is aligned with the flexible hooks which snap back to their unflexed positions and engage with the notch area of the hollow center post.

2. The vape cartridge of claim 1, wherein the opening of the center bore at the first end of the tip lock defines a third diameter which is less than the first diameter of the post tip and greater than the second diameter of the notch area.

3. The vape cartridge of claim 1, wherein each flexible hook includes an outer surface, together the outer surfaces defining an external surface of the hook portion.

4. The vape cartridge of claim 1, wherein the mouthpiece has a first end, a second end, and a center bore extending from the first end to the second end; wherein the center bore includes a first bore region located between the first end and the second end of the mouthpiece, the first bore region operative to receive the external surface of the hook portion of the tip lock when the tip lock is inserted into the center bore of the mouthpiece.

5. The vape cartridge of claim 4, wherein the tip lock includes a central portion located between the hook portion and the second end of the tip lock, the central portion having a flexible wing disposed about a periphery of and extending out from an outer surface of the central portion.

6. The vape cartridge of claim 5, wherein the flexible wing comprises a plurality of flexible wings disposed about a periphery of and extending out from an outer surface of the central portion.

7. The vape cartridge of claim 5, wherein the center bore of the mouthpiece includes a second bore region located between the first bore region and the second end of the mouthpiece, the second bore region including an inner surface with a circumferential groove disposed therein, the circumferential groove operative to receive and engage the flexible wing when the tip lock is inserted into the center bore of the mouthpiece.

8. The vape cartridge of claim 5, wherein the tip lock further includes a gasket engagement surface on an exterior of an end portion of the tip lock extending from the flexible wing to the second end of the tip lock.

9. The vape cartridge of claim 8, wherein the subassembly tip further includes a gasket member having a first end including a recess, the recess operative to receive the gasket engagement surface on an exterior of an end portion of the tip lock when the tip lock is mated to the gasket member; the gasket member further including a center bore extending from the first end to a second end, a gasket seal extending out from and about a periphery of the center bore of the gasket member at the first end, and one or more ridges along an outer surface of the gasket member extending from the gasket seal to proximate the second end of the gasket member; wherein when the tip lock is mated to the gasket member, the center bore of the gasket member is aligned with the center bore of the tip lock.

10. The vape cartridge of claim 9, wherein when the subassembly base and the subassembly tip are mated, the hollow center post of the subassembly base passes through the center bore of the gasket member, the center bore of the tip lock, and into the center bore of the mouthpiece until the post tip of the hollow center post is received within a third bore region of the center bore of the mouthpiece.

11. The vape cartridge of claim 9, wherein the one or more ridges are operative to retain the gasket in the interior region of the hollow cylinder after a disassembly of the subassembly base from the subassembly tip.

12. The vape cartridge of claim 1, wherein a force less than 6 kg will mate the subassembly base to the subassembly tip or will mate the tip lock to the mouthpiece; and wherein a force greater than 20 kg is required to disassemble the subassembly base from the subassembly tip or to un-mate the tip lock from the mouthpiece.

13. The vape cartridge of claim 12, wherein the force greater than 20 kg to disassemble the subassembly base from the subassembly tip will cause the flexible hooks to fail, and wherein the force greater than 20 kg to un-mate the tip lock from the mouthpiece will cause the flexible wing to fail.

14. The vape cartridge of claim 1, wherein disassembly of the vape cartridge results in a tamper-evident damage to the flexible hooks or results in a tamper-evident damage to the flexible wings.

15. The vape cartridge of claim 11, wherein the mouthpiece includes an edge formed at the second end of the mouthpiece between the inner surface of the second bore region and an exterior surface of the mouthpiece.

16. The vape cartridge of claim 15, wherein the edge at the second end of the mouthpiece extends outward from an outer surface of the hollow cylinder when the subassembly base is mated to the subassembly tip, and the edge is operative to receive a force greater than 20 kg.

17. The vape cartridge of claim 1, wherein the hollow center post includes a side hole traversing from the interior region of the hollow cylinder to an interior region of the hollow center post and positioned in the interior region of the hollow cylinder on the post diameter, wherein the side hole allows a pressure to release from the interior region of the cylinder and allows the pressure to traverse through the side hole during a mating of the subassembly tip and the subassembly base.

18. The vape cartridge of claim 17, wherein the center bore of a gasket member covers the side hole of the hollow center post after the subassembly tip is mated to the subassembly base.

19. The vape cartridge of claim 18, wherein the center bore of the gasket member covering the side hole prevents a leakage of vape material through the side hole.

20. The vape cartridge of claim 9, wherein the gasket member comprises silicone.

21. The vape cartridge of claim 1, wherein the hollow center post comprises stainless steel.

22. The vape cartridge of claim 1, wherein the hollow cylinder is transparent.

23. The vape cartridge of claim 1, wherein the mouthpiece comprises wood, metal, plastic, ceramic, polymer, or a combination thereof.

24. The vape cartridge of claim 1, wherein the tip lock comprises polymer, metal, alloy, composite, or a combination thereof.

* * * * *